US008981632B2

(12) United States Patent
Unger et al.

(10) Patent No.: US 8,981,632 B2
(45) Date of Patent: Mar. 17, 2015

(54) ANTI-FOULING SPARK PLUG AND METHOD OF MAKING

(75) Inventors: Peter D. Unger, Morristown, OH (US); Ronald P. Rohrbach, Flemington, NJ (US); Jeffrey T. Boehler, Holland, OH (US); Jing Zheng, Findlay, OH (US)

(73) Assignee: Fram Group IP LLC, Lake Forest, IL (US)

( * ) Notice: Subject to any disclaimer, the term of this patent is extended or adjusted under 35 U.S.C. 154(b) by 218 days.

(21) Appl. No.: 13/446,322

(22) Filed: Apr. 13, 2012

(65) Prior Publication Data

US 2012/0299457 A1 Nov. 29, 2012

Related U.S. Application Data

(60) Provisional application No. 61/490,219, filed on May 26, 2011.

(51) Int. Cl.

| | |
|---|---|
| ***H01T 13/20*** | (2006.01) |
| ***H01T 13/38*** | (2006.01) |
| ***H01T 21/02*** | (2006.01) |
| ***H01T 13/14*** | (2006.01) |

(52) U.S. Cl.

CPC ..... *H01T 21/02* (2013.01); *H01T 13/14* (2013.01); *H01T 13/20* (2013.01)

USPC ..... 313/118

(58) Field of Classification Search

CPC ..... H01T 13/14; H01T 13/20

USPC ..... 313/118, 141

See application file for complete search history.

(56) References Cited

U.S. PATENT DOCUMENTS

| | | | | |
|---|---|---|---|---|
| 4,084,976 | A * | 4/1978 | Hinton | 501/26 |
| 4,092,264 | A | 5/1978 | Tsang et al. | |
| 4,250,426 | A | 2/1981 | Nakajima et al. | |
| 4,267,483 | A | 5/1981 | Nakajima et al. | |
| 4,415,828 | A | 11/1983 | Mizuno et al. | |
| 4,972,811 | A * | 11/1990 | Baresel et al. | 123/143 B |
| 5,109,178 | A | 4/1992 | Yoshida et al. | |
| 5,274,298 | A | 12/1993 | Cassidy et al. | |
| 5,550,424 | A | 8/1996 | Jennrich et al. | |
| 5,952,769 | A | 9/1999 | Budaragin | |
| 6,051,529 | A | 4/2000 | Brezny | |
| 6,060,821 | A | 5/2000 | Suzuki et al. | |
| 6,090,191 | A | 7/2000 | Atlanova et al. | |
| 6,521,671 | B1 * | 2/2003 | Ishikawa et al. | 516/88 |
| 6,548,944 | B1 | 4/2003 | Morita | |
| 6,589,900 | B1 | 7/2003 | Kotze | |

(Continued)

OTHER PUBLICATIONS

Search Report for PCT/US2012/033497, dated Oct. 31, 2012.

(Continued)

*Primary Examiner* — Sikha Roy

(74) *Attorney, Agent, or Firm* — Erin J. Fox; Barnes & Thornburg LLP

(57) ABSTRACT

A spark plug is provided. The spark plug has an insulative sleeve with a central axial bore and an exterior surface of a shaped tip portion. A coating is disposed on the exterior surface of the shaped tip portion and the coating comprises a transition metal compound or a combination of transition metal compounds, and an alkali metal compound. A center electrode extends through the central axial bore of the insulative sleeve. A metal sleeve is provided, wherein the insulating sleeve is positioned within, and secured to, the metal shell. A ground electrode is coupled to the metal shell and positioned in a spaced relationship relative to the center electrode so as to define a spark gap.

8 Claims, 4 Drawing Sheets

(56) References Cited

U.S. PATENT DOCUMENTS

| | | | | |
|---|---|---|---|---|
| 6,858,975 | B1 | 2/2005 | Matsutani | |
| 6,888,293 | B2 | 5/2005 | Roessler et al. | |
| 2002/0033659 | A1 | 3/2002 | Nishikawa et al. | |
| 2003/0122462 | A1 * | 7/2003 | Nishikawa et al. | 313/143 |
| 2003/0127959 | A1 * | 7/2003 | Nishikawa et al. | 313/143 |
| 2006/0055297 | A1 | 3/2006 | Koyama et al. | |
| 2007/0188063 | A1 | 8/2007 | Lykowski | |

OTHER PUBLICATIONS

Mul et al., "Soot Oxidation Catalyzed by a Cu/K/Mo/Cl Catalyst: Evaluation of the Chemistry and Performance of the Catalyst," Applied Catalysis B: Environmental, No. 6, pp. 339-352 (1995).

Neeft, et al., "Feasibility Study Towards a Cu/K/Mo/(Cl) Soot Oxidation Catalyst for Application in Diesel Exhaust Gases," Applied Catalysis B: Environmental, No. 11, pp. 365-382 (1997).

* cited by examiner

ANTI-FOULING SPARK PLUG AND METHOD OF MAKING

CROSS REFERENCE TO RELATED APPLICATIONS

This application claims the benefit of U.S. Provisional Application Ser. No. 61/490,219 filed on May 26, 2011 the contents of which are incorporated herein in their entirety.

BACKGROUND

In general, spark plugs include an insulative sleeve having a central axial bore through which a center electrode extends. The insulating sleeve is positioned within, and secured to, a metal shell that serves as a mounting platform and interface to an internal combustion engine. The metal sleeve also supports a ground electrode that is positioned in a particular spaced relationship relative to the center electrode so as to generate a spark gap. The insulating sleeve includes a shaped tip portion that resides in a recessed end portion of the metal shell. The shaped tip portion is configured to protect the electrode from engine heat and products of combustion. The spark plug is typically mounted to an engine cylinder head and selectively activated to ignite a fuel/air mixture in an associated engine cylinder.

Over time, products of combustion or combustion deposits build up around the center electrode and insulative sleeve, particularly the shaped tip portion. This build up of combustion product inhibits spark formation across the spark gap. A significant build up of combustion products may foul the spark plug and result in ignition failure, i.e., the combustion products completely block the spark from forming between the center and ground electrodes due to an electrical short circuit formed from the combustion products. Combustion deposit build up is particularly problematic during cold starts. During cold starts, complete combustion of the air/fuel mixture is seldom achieved which results in an increased generation of electrically conductive combustion deposits. As a result of continuous cold starts, electrically conductive combustion deposits build up, resulting in an electrical short circuit between the center electrode and the electrically grounded portion of the spark plug.

Previous, attempts to address combustion deposit build up issues have included silicone oil coatings and particulate vanadium oxide deposition on the insulating sleeve. These coatings have failed to adequately address the issue—suffering from inadequate performance at elevated temperature, inadequate endurance, or insufficient reduction of combustion deposit build up.

Accordingly, there is a need for a spark plug which has a decreased susceptibility to electrically conductive combustion deposit build up in the insulative sleeve.

BRIEF DESCRIPTION

In accordance with one embodiment of the invention, a spark plug is provided. The spark plug has an insulative sleeve with a central axial bore and an exterior surface of a shaped tip portion. A coating is disposed on the exterior surface of the shaped tip portion and the coating comprises a transition metal compound or a combination of transition metal compounds, and an alkali metal compound. A center electrode extends through the central axial bore of the insulative sleeve. A metal sleeve is provided, wherein the insulating sleeve is positioned within, and secured to, the metal shell. A ground electrode is coupled to the metal shell and positioned in a spaced relationship relative to the center electrode so as to define a spark gap.

In accordance with another embodiment of the invention, a method of coating a spark plug insulator is provided. The method includes the step of forming a first slurry solution including one or more transitional metal compounds, the one ore more transitional metals comprising up to 70 weight percent of the total weight of the slurry solution. The first slurry solution is applied to an insulative sleeve. A first coating is formed by air drying the first slurry solution on the insulative sleeve for a first predetermined time at a first predetermined temperature. The first coating is calcined at a third predetermined temperature for a third predetermined amount of time.

In accordance with still another embodiment of the invention, another method of coating a spark plug insulator is provided. The method includes forming a first slurry solution including from a alkali metal compound, the alkali metal compound being up to 70 weight percent of the total weight of the slurry solution. The first slurry solution is applied to an insulative sleeve. A first coating is formed by air drying the first slurry solution on the insulative sleeve for a first predetermined time at a first predetermined temperature. The first coating is calcined at a third predetermined temperature for a third predetermined amount of time.

DETAILED DESCRIPTION

Figure 1:
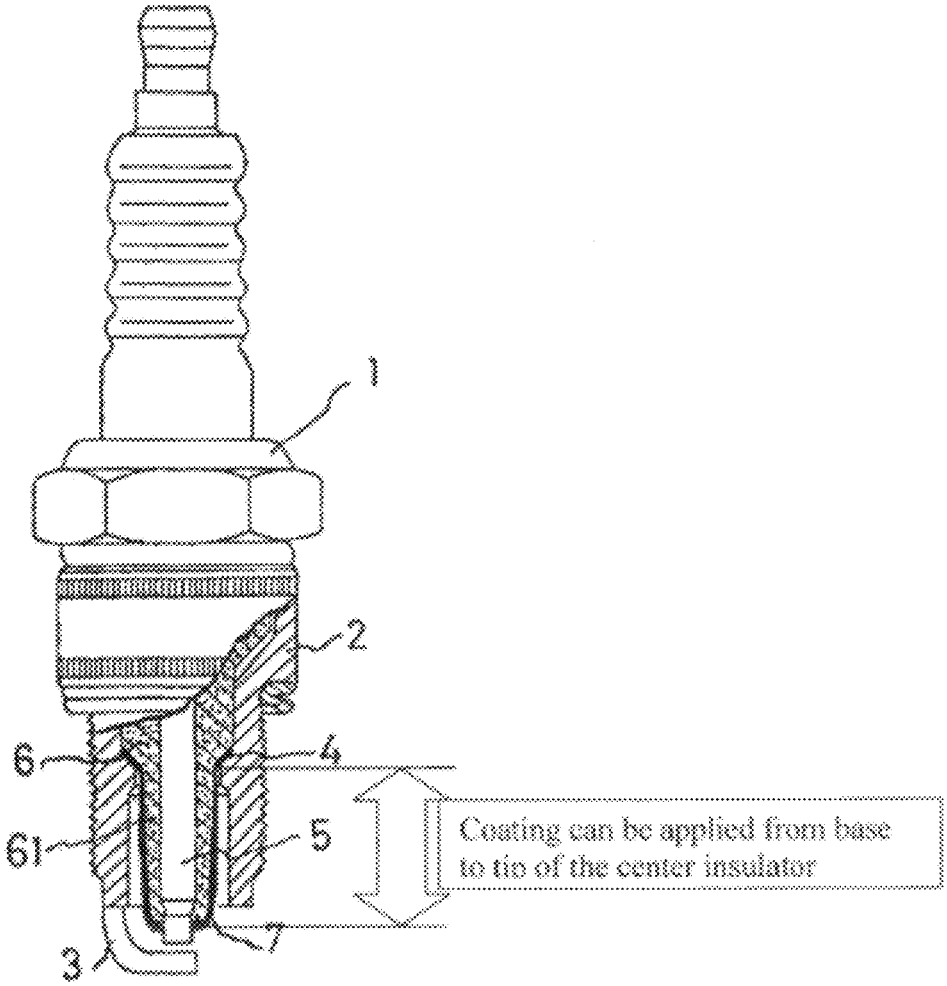
FIG. 1 is a side view of a spark plug, partly shown in cross section.

The coating, as described herein, is a substantially continuous coating. A substantially continuous coating, as defined herein, describes a coating which is has no breaks or gaps visible to the naked eye and covers a portion of shaped tip portion the exterior surface of the insulative sleeve. The coating thickness can range from a molecular monolayer to several micrometers in thickness. In one embodiment, the monolayer may be 5 to 15 micrometers in thickness. In other embodiments the coating has a thickness of 1-10 micrometers.

Suitable transition metal compounds comprise one or more transition metals. Exemplary transition metals include chromium, molybdenum, tungsten, zirconium, iron, lead, vanadium, niobium, tantalum, copper, silver, gold, nickel, platinum, and palladium. Exemplary transition metal compounds include oxides and carbonates of the foregoing transition metals. For simplicity of handling it is desirable for the transition metal compound to be water soluble. Exemplary water soluble compounds include copper nitrate, copper chloride, ammonium heptamolybdate 4 hydrate, molybdenum chloride, potassium paramolybdate, and combinations of two or more of the foregoing compounds.

In some embodiments the coating may comprise a combination of an early transition metal compound and a late transition metal compound. Exemplary early transition metals include chromium, molybdenum, tungsten, vanadium, niobium, and tantalum. Exemplary late transition metals include copper, silver, gold, nickel, platinum, and palladium. An exemplary combination comprises a molybdenum compound and a copper compound.

The alkali metal compound may comprise lithium, sodium, potassium, cesium, or a combination of two or more of the foregoing alkali metals. For simplicity in handling it is desirable for the alkali metal compound to be water soluble. Exemplary water soluble alkali metal compounds include potassium chloride, potassium carbonate, potassium bicarbonate, potassium nitrate, potassium hydroxide, and combinations of two or more of the foregoing compounds.

The molar ratio of the transition metal compound to the alkali metal compound (transition metal/alkali metal) can be 1:1 to 16:1. When the coating comprises late and early transition metal compounds the molar ratio of the late transition metal compound to early transition metal compound to alkali metal compound can be 1:0.5:1 to 1:7:1.

Surprisingly it has been found that the coatings described above are not sufficiently conductive, at the thicknesses described herein, to interfere with the operation of the spark plug. Without being bound by theory it is speculated that the coating may function as a catalyst to facilitate combustion either during a cold start or during subsequent operation, thus reducing or removing the combustion deposit build up on the surface. Alternatively, the coating may absorb oxygen which it can then provide during combustion at the interface of the insulative sleeve and the combustion products, thus facilitating more complete combustion.

The coating is formed on the insulative sleeve by forming a slurry or solution comprising the transition metal compound or combination of transition metal compounds. The solution can further comprise the alkali metal compound. The slurry or solution is applied to the insulative sleeve by any appropriate method such as painting, dip coating, spray coating and the like. In some embodiments the slurry is an aqueous slurry. In some embodiments the solution is an aqueous solution. The slurry or solution can comprise up to 70 weight percent of the transition metal compound or combination of transition metal compounds, based on the total weight of the slurry or solution. Within this range the amount of transition metal compound(s) in the slurry or solution can be 0.1 to 10 weight percent, or, more specifically, 0.1 to 5 weight percent. Slurries can be used at higher weight percents than solutions. Solutions, if made too concentrated can have solubility issues. The slurry or solution can comprise up to 70 weight percent of the alkali metal compound, based on the total weight of the slurry or solution. Within this range the amount of alkali metal compound in the slurry or solution can be 0 to 10 weight percent, or more specifically 0.25 to 7.5 weight percent. In another embodiment, the alkali metal compound in the slurry or solution can be 0.5 to 5 weight percent.

The applied slurry or solution is allowed to air dry at room temperature to form a coated insulative sleeve. The coated insulative sleeve can then treated at an elevated temperature, such as 70 to 150 degrees C. for 30 minutes to 60 hours. The coated insulative sleeve is then calcined at a temperature of 475 to 950 degrees C. for a period of 30 minutes to several hours. Within this range the calcination time can be 30 minutes to 1.5 hours. After calcining alkali metal solution or slurry can be applied and drying and calcining repeated to form a coating with alkali metal compound primarily at the surface.

The alkali metal can also be applied separately in a two-stage process. In this scenario, a first coating comprising a mixture of transition metals may be applied and calcined as described above. The sleeve thus coated may be then further subjected to a second coating of an alkali metal solution, and then finally calcined as described above. The first coating might comprise either of the transition metals only or a mixture containing alkali metal. The two-stage process can effectively result in surface enrichment of the final coating with alkali metal.

An exemplary spark plug is shown in FIG. 1. The spark plug, 1, has a metal shell, 2, a ground electrode, 3, a center electrode, 5, an insulative sleeve, 6, a shaped tip portion of the insulative sleeve, 61, and a coating, 7, disposed on the insulative sleeve. The longitudinal extent of the coating (from center electrode to metal shell) can vary. Importantly, the coating should form a continuous coating around the circumference of the insulative sleeve in at least one location.

The invention is further illustrated by the following non-limiting examples.

Several coatings were screened for conductivity and impact on combustion deposit accumulation/removal using the following procedure. An aqueous solution of the metal compounds was coated onto half of an alumina slide, leaving one side uncoated to function as a control. After coating the slide was air dried and calcined at 475-975 degrees C. for 60 minutes. Calcination temperatures were approximately 625-650 degrees C. for the Cu/Mo/K mixes and higher for CuO and $V_2O_5$. Resistivity (electrical resistance) was measured using a Fluke 1507 Megohmmeter. Higher resistance means less conductivity. The candidates were then further evaluated for soot burn off (conductive deposit removal). The entire strip was coated with soot (combustion products) and placed within a vycor tube in a tube furnace and a cole-parmer digital temperature controller was used to adjust the temperature from ambient temperature to about 625° C. at a heating rate of 8.5° C./minute. Observations were made on achieving 200, 300, 400, 450, 475, 500, 525, 550, 575, 600 and 625° C. Soot loss was visually estimated and recorded. Results are shown in FIGS. 2, 3 and 4.

Figure 2:
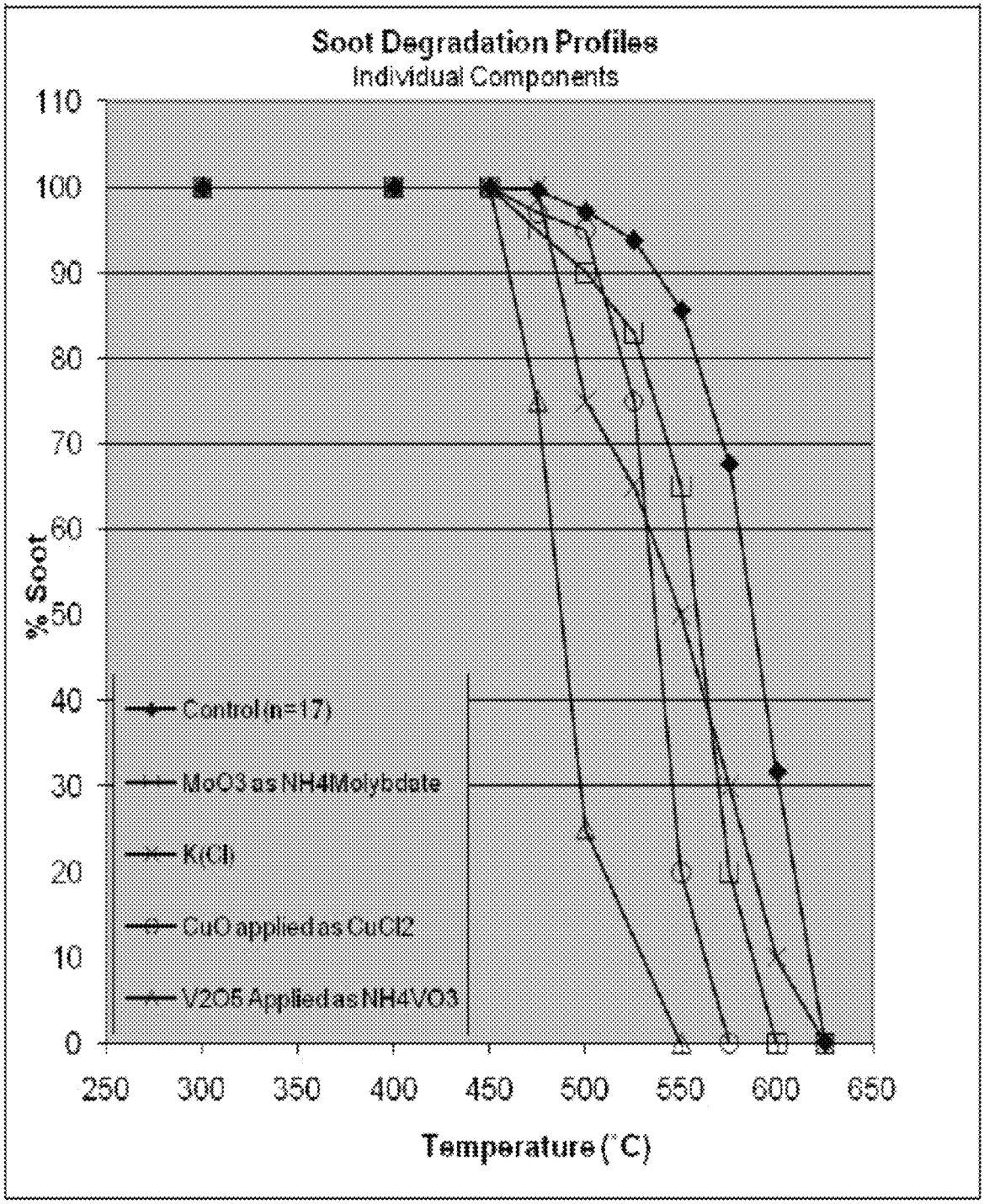
FIGS. 2-4 are graphical representations of data described in the examples.

FIG. 2 shows soot degradation curves for the individual components as well as vanadium pentoxide (as a comparison). Each individual component shows an improvement over the control but only moderately good results compared to vanadium pentoxide.

Figure 3:
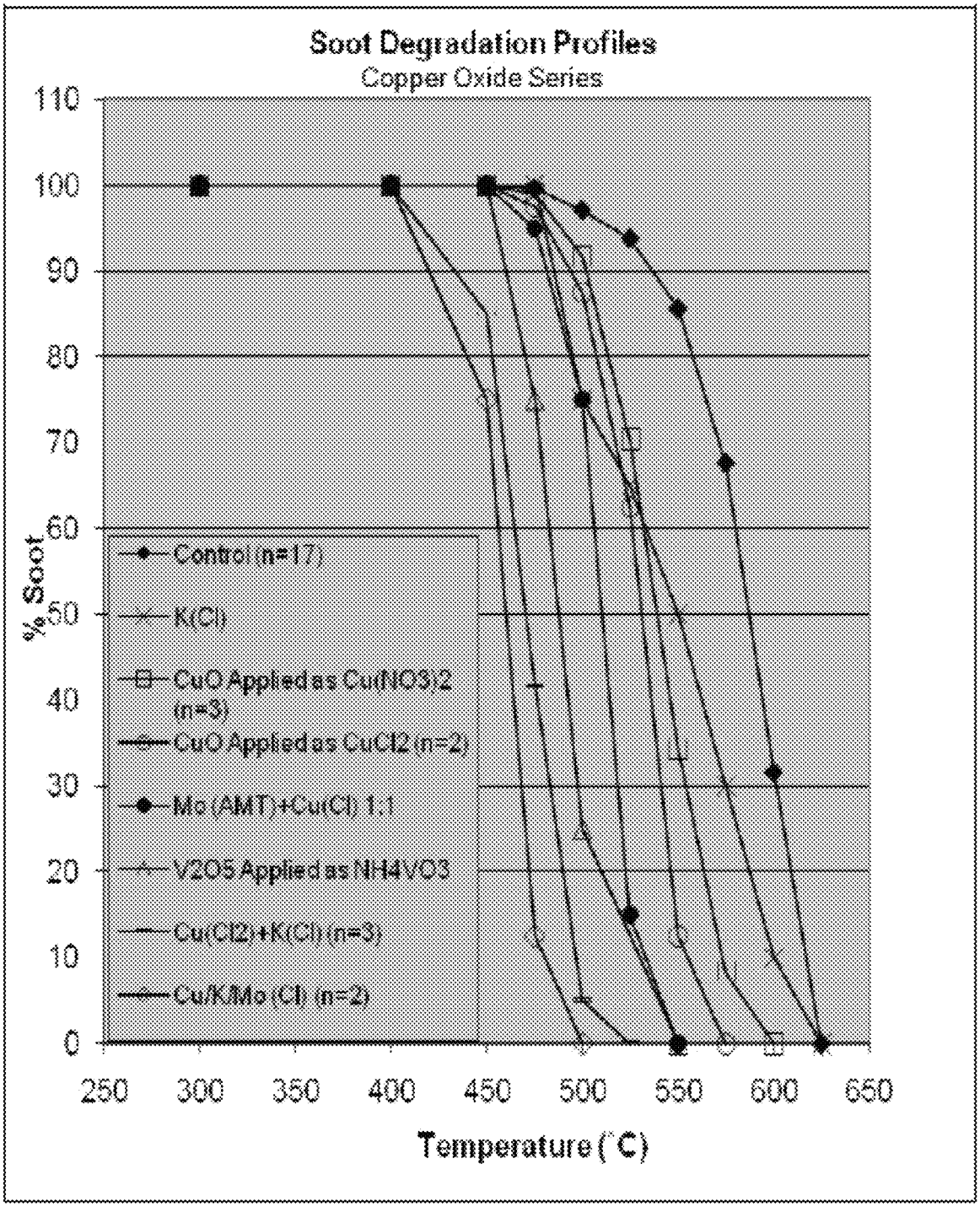

FIG. 3 shows soot degradation curves for the individual components, vanadium pentoxide (as a comparison), two component mixtures containing a copper compound, and the tri component mixture containing a copper compound, a molybdenum compound and a potassium compound. The tri component mixture started clearing soot at a lower temperature than vanadium pentoxide and cleared the soot faster with complete removal of the soot at a lower temperature than the vanadium pentoxide.

Figure 4:
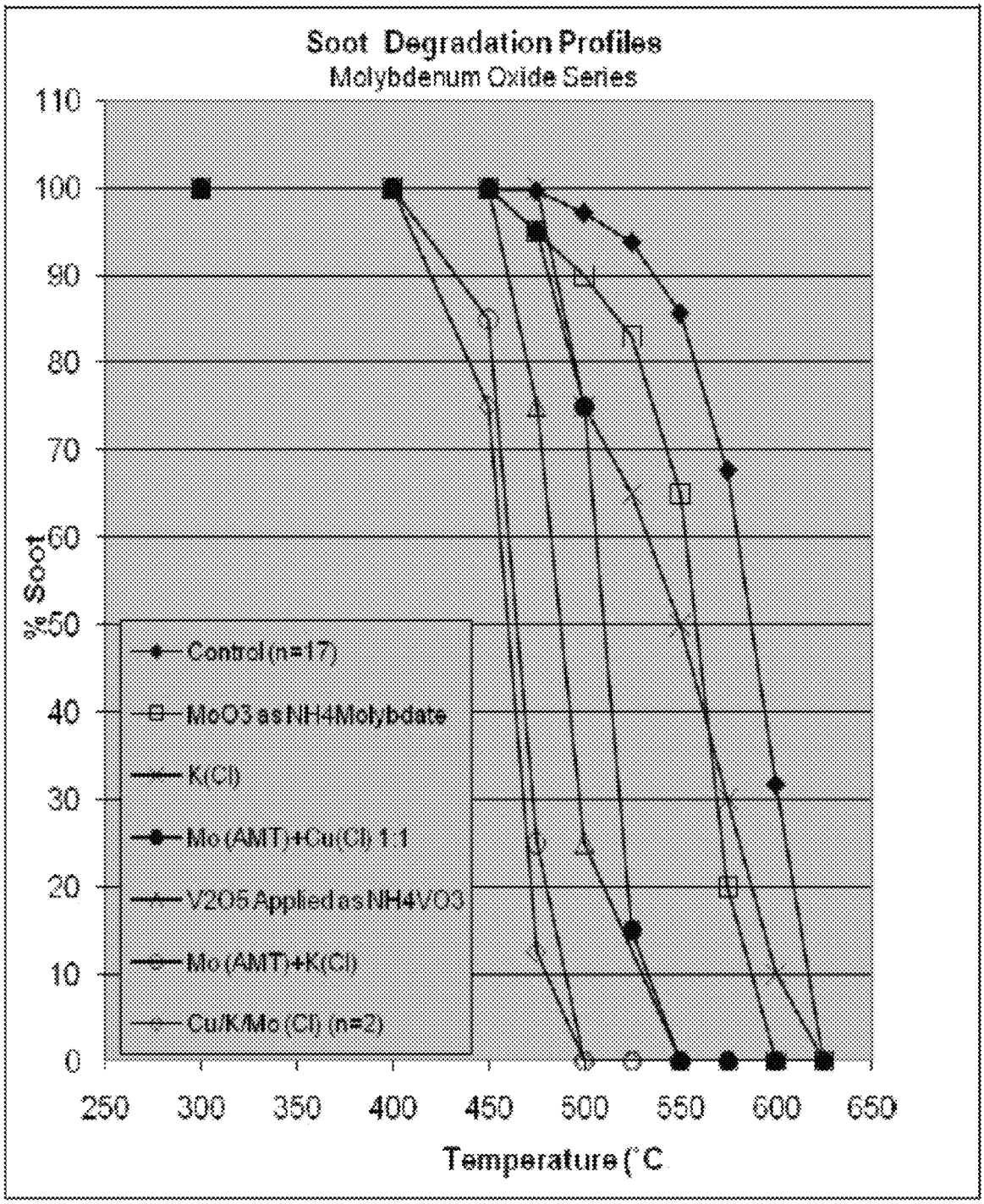

FIG. 4 shows soot degradation curves for molybdenum and potassium as individual components, vanadium pentoxide (as a comparison), two component mixtures containing a molybdenum compound, and the tri component mixture containing a copper compound, a molybdenum compound and a potassium compound. The tri component mixture demonstrates the best performance with the molybdenum/potassium combination also demonstrating good performance.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

All ranges disclosed herein are inclusive of the endpoints, and the endpoints are combinable with each other.

All cited patents, patent applications, and other references are incorporated herein by reference in their entirety.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another.

The invention claimed is:

1. A spark plug comprising an insulative sleeve having a central axial bore and an exterior surface of a shaped tip portion, wherein a coating is disposed on the exterior surface of the shaped tip portion and the coating comprises a transition metal compound of molybdenum chloride and an alkali metal compound of potassium;

a center electrode extending through the central axial bore of the insulative sleeve;

a metal shell, wherein the insulating sleeve is positioned within, and secured to, the metal shell; and a ground electrode coupled to the metal shell and positioned in a spaced relationship relative to the center electrode so as to define a spark gap.

2. The spark plug of claim 1, wherein the coating has a thickness of a monomolecular layer to 20 micrometers.

3. The spark plug of claim 1, wherein the transition metal compound comprises a water soluble compound of molybdenum chloride.

4. The spark plug of claim 1, wherein the molar ratio of the transition metal compound to the alkali metal compound is 1:1 to 16:1.

5. A spark plug comprising an insulative sleeve having a central axial bore and an exterior surface of a shaped tip portion, wherein a coating is disposed on the exterior surface of the shaped tip portion and the coating comprises at least one transition metal compound and at least one alkali metal compound, wherein the transition metal compound is selected from the group consisting of copper nitrate, copper chloride, copper carbonate, ammonium heptamolybdate 4 hydrate, molybdenum chloride, potassium paramolybdate, and combinations of two or more of the foregoing compounds;

a center electrode extending through the central axial bore of the insulative sleeve;

a metal shell, wherein the insulating sleeve is positioned within, and secured to, the metal shell; and a ground electrode coupled to the metal shell and positioned in a spaced relationship relative to the center electrode so as to define a spark gap.

6. The spark plug of claim 5, wherein the coating has a thickness of a monomolecular layer to 20 micrometers.

7. The spark plug of claim 5, wherein the alkali metal compound is selected from the group consisting of lithium, sodium, potassium, cesium, and a combination of two or more of the foregoing alkali metals.

8. The spark plug of claim 5, wherein the molar ratio of the transition metal compound to the alkali metal compound is 1:1 to 16:1.

* * * * *